US009726140B2

(12) United States Patent
Okuda

(10) Patent No.: US 9,726,140 B2
(45) Date of Patent: Aug. 8, 2017

(54) INTERNAL COMBUSTION ENGINE CONTROL APPARATUS

(71) Applicant: Mitsubishi Electric Corporation, Tokyo (JP)

(72) Inventor: Hiroshi Okuda, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 307 days.

(21) Appl. No.: 14/617,343

(22) Filed: Feb. 9, 2015

(65) Prior Publication Data

US 2016/0084214 A1 Mar. 24, 2016

(30) Foreign Application Priority Data

Sep. 24, 2014 (JP) ..... 2014-193311

(51) Int. Cl.
*F02P 17/12* (2006.01)
*F02P 11/06* (2006.01)
(Continued)

(52) U.S. Cl.
CPC ..... *F02P 11/06* (2013.01); *F02D 37/02* (2013.01); *F02P 9/002* (2013.01); *F02P 11/02* (2013.01);
(Continued)

(58) Field of Classification Search
CPC .. F02P 3/0552; F02P 3/0554; F02P 2017/006; F02P 17/12; F02P 17/121;
(Continued)

(56) References Cited

U.S. PATENT DOCUMENTS 4,773,380 A * 9/1988 Narita ..... F02P 3/0442 123/609
4,886,029 A * 12/1989 Lill ..... F02P 17/12 123/479
(Continued)

FOREIGN PATENT DOCUMENTS

JP 62-135668 A 6/1987
JP 6-50250 A 2/1994
JP 2013-177881 A 9/2013

OTHER PUBLICATIONS

Communication dated Dec. 22, 2015 from the Japanese Patent Office issued in corresponding Application No. 2014-193311.

*Primary Examiner* — Thomas Moulis
(74) *Attorney, Agent, or Firm* — Sughrue Mion, PLLC; Richard C. Turner

(57) ABSTRACT

An internal combustion engine control apparatus includes: an ignition coil including a primary coil and a secondary coil that are magnetically coupled to each other; a first switch element for turning on and off a current to the primary coil; and a spark plug, for igniting an air-fuel mixture in an internal combustion engine by using a spark discharge caused by switching the first switch element from the ON state to the OFF state. The internal combustion engine control apparatus is configured to: determine occurrence of one of an abnormality in a discharge voltage and a misfire of the spark plug, when the calculated time duration in which a voltage of the primary coil after the switching of the first switch element from the ON state to the OFF state is above a predetermined comparison reference voltage does not fall within an allowable range.

19 Claims, 8 Drawing Sheets

(51) Int. Cl.

| | |
|---|---|
| ***F02D 37/02*** | (2006.01) |
| ***F02P 9/00*** | (2006.01) |
| ***F02P 11/02*** | (2006.01) |
| ***F02P 15/00*** | (2006.01) |
| ***F02P 17/10*** | (2006.01) |
| *F02P 3/04* | (2006.01) |
| *F02P 3/055* | (2006.01) |

(52) U.S. Cl.
CPC ..... *F02P 15/006* (2013.01); *F02P 17/10* (2013.01); *F02P 3/0414* (2013.01); *F02P 3/055* (2013.01); *F02P 17/12* (2013.01)

(58) Field of Classification Search
CPC .. F02P 3/051; F02P 3/053; F02P 17/00; F02P 17/10; F02P 11/06; F02P 11/02
USPC ..... 123/630, 644
See application file for complete search history.

(56) References Cited

U.S. PATENT DOCUMENTS

| | | | | | |
|---|---|---|---|---|---|
| 4,918,389 | A * | 4/1990 | Schleupen | F02P 17/12 | 123/630 |
| 5,208,540 | A * | 5/1993 | Hoeflich | F02P 3/096 | 123/644 |
| 5,418,461 | A * | 5/1995 | Maeda | F02P 17/12 | 123/479 |
| 5,548,220 | A * | 8/1996 | Kawamoto | F02P 17/12 | 123/479 |
| 5,623,209 | A * | 4/1997 | Lepley | F02P 17/12 | 324/379 |
| 5,790,039 | A * | 8/1998 | Palara | F02P 17/12 | 123/479 |
| 6,492,818 | B1 * | 12/2002 | Downs | F02P 3/0838 | 324/382 |
| 6,750,565 | B2 * | 6/2004 | Degen | F02P 3/051 | 123/406.11 |
| 6,766,243 | B1 * | 7/2004 | Haussmann | F02D 41/266 | 123/339.11 |
| 6,948,484 | B2 * | 9/2005 | Umino | F02P 17/00 | 123/198 D |
| 7,644,707 | B2 * | 1/2010 | Kraus | F02P 3/051 | 123/623 |
| 9,470,202 | B2 * | 10/2016 | Torrisi | F02P 9/00 | |
| 2004/0200463 | A1 * | 10/2004 | Ando | F02P 11/06 | 123/630 |
| 2008/0197717 | A1 * | 8/2008 | Lorenzo | F02P 3/053 | 307/139 |
| 2013/0335864 | A1 * | 12/2013 | Trecarichi | F02P 3/051 | 361/36 |

* cited by examiner

INTERNAL COMBUSTION ENGINE CONTROL APPARATUS

BACKGROUND OF THE INVENTION

1. Field of the Invention

The present invention relates to an internal combustion engine control apparatus including a spark plug which is driven by a current interruption-type ignition circuit, for igniting an air-fuel mixture in an internal combustion engine, in particular, a technology of detecting an abnormality in a discharge voltage and a misfire of the spark plug.

2. Description of the Related Art

In recent years, a high compression-ratio technology and a gasoline in-cylinder direct injection technology become more and more important in order to improve fuel efficiency of an internal combustion engine (gasoline engine). When a compression ratio is increased, however, a pressure in a spark discharge gap in a spark plug is increased to disadvantageously increase a discharge voltage of the spark plug. Moreover, when the gasoline in-cylinder direct injection is performed, a difference in density is likely to be generated in an air-fuel mixture. Thus, large spark energy is required to ignite the air-fuel mixture.

When the spark energy increases, electrodes of the spark plug are likely to wear. As a result, if the electrodes wear, the spark discharge gap becomes wider to increase the discharge voltage of the spark plug. Accordingly, there is a fear in that the discharge voltage of the spark plug exceeds a dielectric withstand voltage to cause dielectric breakdown of the spark plug. Moreover, when the discharge voltage of the spark plug exceeds a magnetically induced voltage which can be generated by an ignition coil, the spark plug cannot generate the spark discharge and therefore cannot ignite the air-fuel mixture.

As a related-art internal combustion engine control apparatus which solves the problem described above, there exits one configured to measure the discharge voltage of the spark plug to obtain a degradation state of the spark plug (for example, see Japanese Patent Application Laid-open No. 2013-177881).

However, the related art has the following problems.

According to Japanese Patent Application Laid-open No. 2013-177881, although a state in which the discharge voltage of the spark plug becomes high can be obtained, a state in which the discharge voltage becomes abnormally low or the occurrence of a spark plug misfire cannot be obtained. Moreover, in order to detect the abnormality in the discharge voltage and the misfire of the spark plug, special elements such as a zener diode which withstands a high voltage are required. Further, an additional wiring for connecting the above-mentioned elements to a secondary coil at a high voltage and insulating processing are required. Thus, costs disadvantageously increase.

SUMMARY OF THE INVENTION

The present invention has been made to solve the problems described above and has an object to provide an internal combustion engine control apparatus at low costs, which is capable of detecting an abnormality in a discharge voltage and a misfire of a spark plug.

According to one embodiment of the present invention, there is provided an internal combustion engine control apparatus, including: an ignition coil including a primary coil and a secondary coil that are magnetically coupled to each other; a first switch element for turning on a current to the primary coil when the first switch element is brought into an ON state, and turning off the current to the primary coil when the first switch element is brought into an OFF state; a control computing section for controlling switching between the ON state and the OFF state of the first switch element; and a spark plug, which is to be driven by a current-interruption type ignition circuit, for igniting an air-fuel mixture in an internal combustion engine by using a spark discharge caused by a magnetically induced voltage generated in the secondary coil by switching of the first switch element from the ON state to the OFF state, in which the control computing section is configured to: calculate a time duration in which a voltage of the primary coil after the switching of the first switch element from the ON state to the OFF state is above a predetermined comparison reference voltage; and determine occurrence of one of an abnormality in a discharge voltage of the spark plug and a misfire of the spark plug when the calculated time duration does not fall within an allowable range.

According to one embodiment of the present invention, by measuring the discharge voltage of the spark plug based on the time duration in which the voltage of the primary coil is above the predetermined comparison reference voltage, the internal combustion engine control apparatus capable of detecting the abnormality in the discharge voltage and the misfire of the spark plug can be obtained at low costs.

DETAILED DESCRIPTION OF THE PREFERRED EMBODIMENTS

Figure 1:
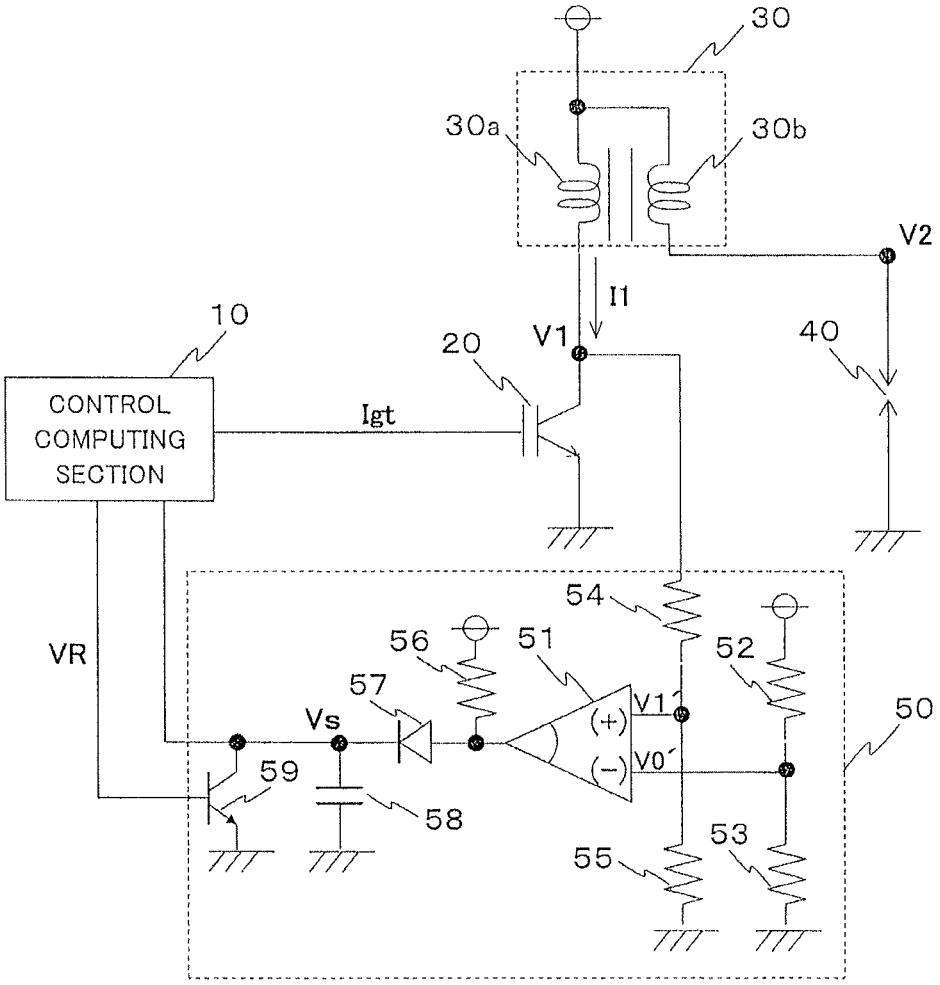
FIG. 1 is an exemplary diagram of a circuit configuration of an internal combustion engine control apparatus according to a first embodiment of the present invention.

Now, an internal combustion engine control apparatus according to exemplary embodiments of the present invention is described referring to the accompanying drawings. In the drawings, the same or corresponding parts are denoted by the same reference symbols for description.

First Embodiment

FIG. 1 is an exemplary diagram of a circuit configuration of an internal combustion engine control apparatus according to a first embodiment of the present invention. The internal combustion engine control apparatus according to the first embodiment includes a control computing section 10, a first switch element 20, an ignition coil 30, a spark plug 40, and a voltage detecting circuit 50. As the control computing section 10, an engine control unit (ECU) for a vehicle is used.

The ignition coil 30 includes a primary coil 30*a* and a secondary coil 30*b* which are magnetically coupled to each other so as to generate a spark discharge in a spark discharge gap in the spark plug 40. The first switch element 20 is turned on and off based on a control signal (hereinafter referred to as "Igt signal") from the control computing section 10 to control a flow (ON) and interruption (OFF) of a primary coil current I1.

The voltage detecting circuit 50 includes a comparator 51, voltage-dividing resistors 52, 53, 54, and 55, a resistor 56, a diode 57, a capacitor 58, and a second switch element 59. The voltage detecting circuit 50 detects a primary coil voltage V1.

The comparator 50 compares the primary coil voltage V1 and a predetermined comparison reference voltage V0. In practice, instead of directly comparing the primary coil voltage V1 and the comparison reference voltage V0 with each other, the comparator 51 compares a voltage V1' which is set by the primary coil voltage V1 and the voltage-dividing resistors 54 and 55, and a voltage V0' (=V0×V1'/V1) which is set by a power supply voltage and the voltage-dividing resistors 52 and 53, as illustrated in FIG. 1.

An output from the comparator 51 is brought into an open collector state when the primary coil voltage V1 is above the comparison reference voltage V0. When the output from the comparator 51 is in the open collector state, the capacitor 58 is charged from a power supply through the resistor 56. On the other hand, when the primary coil voltage V1 is equal to or lower than the comparison reference voltage V0, the output from the comparator 51 is set at a GND level. Therefore, the capacitor 58 is not charged, and a charging voltage Vs before the voltage V1 becomes equal to or lower than the comparison reference voltage V0 is maintained. The diode 57 serves to prevent the capacitor 58 from discharging.

As a result, the charging voltage Vs of the capacitor 58 increases in proportion to a time duration in which the primary coil voltage V1 is above the comparison reference voltage V0. Moreover, the control computing section 10 enables the capacitor 58 to discharge by controlling the second switch element 59 connected in parallel to the capacitor 58. Therefore, the control computing section 10 resets the charging voltage Vs of the capacitor 58 to 0 V in advance before turning on the first switch element 20 so that a value of the charging voltage Vs itself can be made proportional to the time duration in which the primary coil voltage V1 is above the comparison reference voltage V0.

As described above, the control computing section 10 controls the second switch element 59 and measures the charging voltage Vs of the capacitor 58. As a result, the control computing section 10 can obtain the time duration in which the primary coil voltage V1 is above the comparison reference voltage V0.

Figure 2:
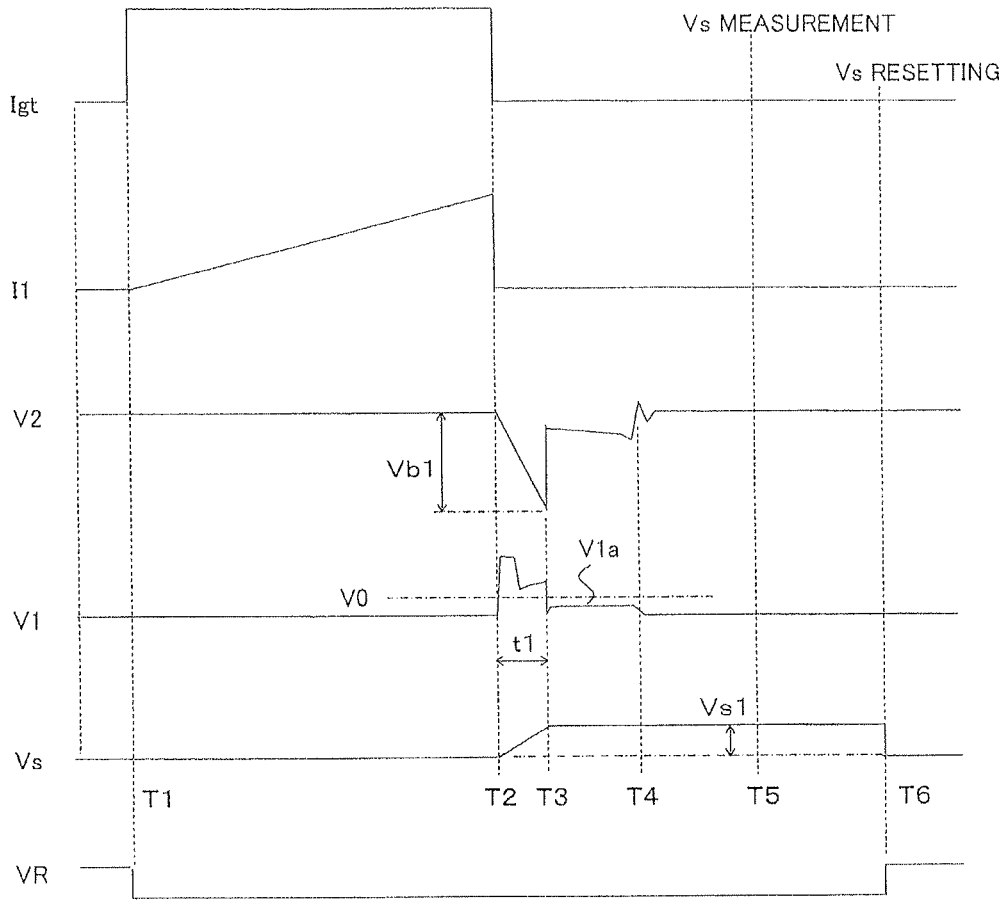
FIG. 2 is a timing chart of the internal combustion engine control apparatus according to the first embodiment of the present invention.

FIG. 2 is a timing chart of the internal combustion engine control apparatus according to the first embodiment of the present invention. The control computing section 10 sets a signal VR at a high level to bring the second switch element 59 into an energized (ON) state. In this manner, the charging voltage Vs of the capacitor 58 is reset to 0 V in advance.

At a time T1, when the level of the Igt signal output from the control computing section 10 becomes high, the first switch element 20 is turned on to start the flow of the primary coil current I1 through the primary coil 30*a*. Simultaneously, the control computing section 10 sets the signal VR at a low level to bring the second switch element 59 into an interrupted (OFF) state.

At a time T2, when the level of the Igt signal output from the control computing section 10 becomes low, the first switch element 20 is turned off to interrupt the primary coil current I1 which flows through the primary coil 30*a*. As a result, a magnetic flux in the ignition coil 30 rapidly changes to cause a change in the primary coil voltage V1 and a secondary coil voltage V2 due to electromagnetic induction.

Specifically, the secondary coil voltage V2 starts gradually decreasing at the time T2. The primary coil voltage V1 has a high peak voltage immediately after the time T2 and then gradually increases. The high peak voltage of the primary coil voltage V1 is a surge voltage generated due to a primary coil leakage inductance caused when the perfect coupling between the primary coil 30*a* and the secondary coil 30*b* fails. The voltage which gradually increases after the generation of the surge voltage is a voltage generated by the primary coil 30*a* and the secondary coil 30*b* which form a transformer having a winding turns ratio N. At this time, a change amount ΔV1 in the primary coil voltage V1 and a change amount ΔV2 in the secondary coil voltage V2 have a relationship: $|\Delta V1|=|\Delta V2|/N$.

The voltage detecting circuit 50 compares the primary coil voltage V1 and the comparison reference voltage V0. When the primary coil voltage V1 exceeds the comparison reference voltage V0, the output from the comparator 51 is brought into the open collector state. As a result, the capacitor 58 is charged to increase the charging voltage Vs.

At a time T3, when a magnetically induced voltage generated in the secondary coil 30*b* exceeds a discharge voltage Vb1 in the spark discharge gap in the spark plug 40, a spark discharge is caused in the spark plug 40. As a result, the secondary coil voltage V2 rapidly converges to a glow/arc discharge voltage. With the convergence of the secondary coil voltage V2, the primary coil voltage V1 also rapidly drops to become a voltage V1*a* lower than the comparison reference voltage V0.

Further, at the time T3, when the primary coil voltage V1 becomes equal to or lower than the comparison reference voltage V0, the output from the comparator 51 is set at the GND level. As a result, the charging for the capacitor 58 is stopped. After the time T3, a charging voltage Vs1 at the time T3 is maintained. In this manner, the capacitor 58 is charged only for a time duration t1.

The comparison reference voltage V0 may be set so as to be lower than the primary coil voltage V1 during the time duration t1 and higher than the voltage V1*a* during the glow/arc discharge time period, for example, to about 100 V.

At a time T4, when the spark discharge of the spark plug 40 ends, the primary coil voltage V1 and the secondary coil voltage V2 both converge to about 0 V.

At a time T5 after elapse of a predetermined time period from the time T2, the control computing section 10 reads the charging voltage Vs1 of the capacitor 58.

At a time T6 after the reading of the charging voltage Vs1 of the capacitor 58 is completed (or after elapse of a predetermined time period from the time T5), the control computing section 10 sets the signal VR at the high level to bring the second switch element 59 into a conductive (ON) state. In this manner, the capacitor 58 is discharged to reset the charging voltage Vs to 0 V.

Figure 3:
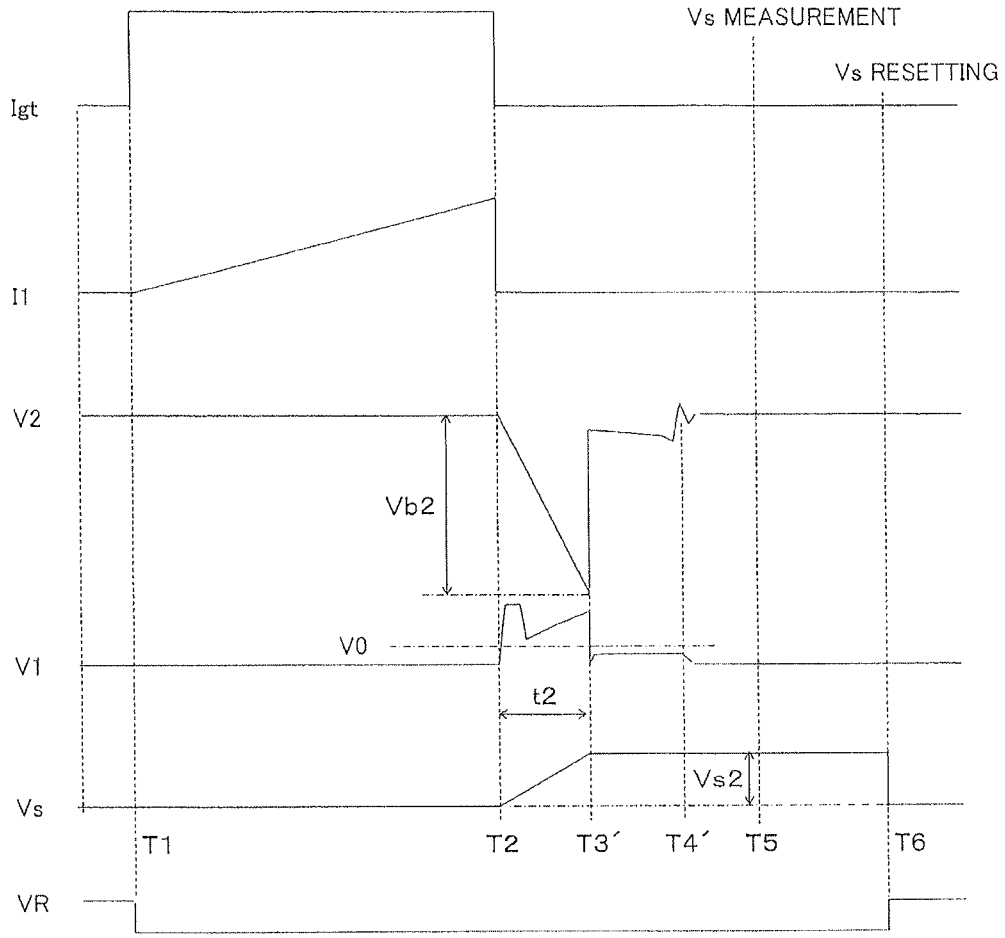
FIG. 3 is a timing chart of the internal combustion engine control apparatus according to the first embodiment of the present invention in the case where a discharge voltage of a spark plug has an abnormality.

FIG. 3 is a timing chart of the internal combustion engine control apparatus according to the first embodiment of the present invention in the case where a discharge voltage Vb of the spark plug 40 has an abnormality. FIG. 3 differs from FIG. 2 referred to above in the discharge voltage Vb, mainly in an operation from a time T3' to a time T4'. The operation at the times except for the time period from the time T2' to the time T3' is the same as that illustrated in FIG. 2, and therefore the description thereof is herein omitted.

At the time T3', when the magnetically induced voltage generated in the secondary coil 30*b* exceeds a discharge voltage Vb2 in the spark discharge gap in the spark plug 40, the spark discharge is caused in the spark plug 40. As a result, the secondary coil voltage V2 rapidly converges to the glow/arc discharge voltage.

The discharge voltage Vb2 illustrated in FIG. 3 is larger than the discharge voltage Vb1 illustrated in FIG. 2. A time duration t2 illustrated in FIG. 3 is longer than the time duration t1 illustrated in FIG. 2, whereas a charging voltage Vs2 of the capacitor 58 at the time T3' is higher than the charging voltage Vs1 illustrated in FIG. 2.

At the time T4', when the spark discharge in the spark plug 40 ends, the primary coil voltage V1 and the secondary coil voltage V2 both converge to about 0 V.

As described above, even when the discharge voltage Vb of the spark plug 40 becomes high, the discharge voltage Vb of the spark plug 40 can be detected by measuring the time duration in which the primary coil voltage V1 is above the comparison reference voltage V0 based on the charging voltage Vs of the capacitor 58. Moreover, even when the discharge voltage Vb is low, the discharge voltage Vb of the spark plug 40 can be detected by using the same method.

Figure 4:
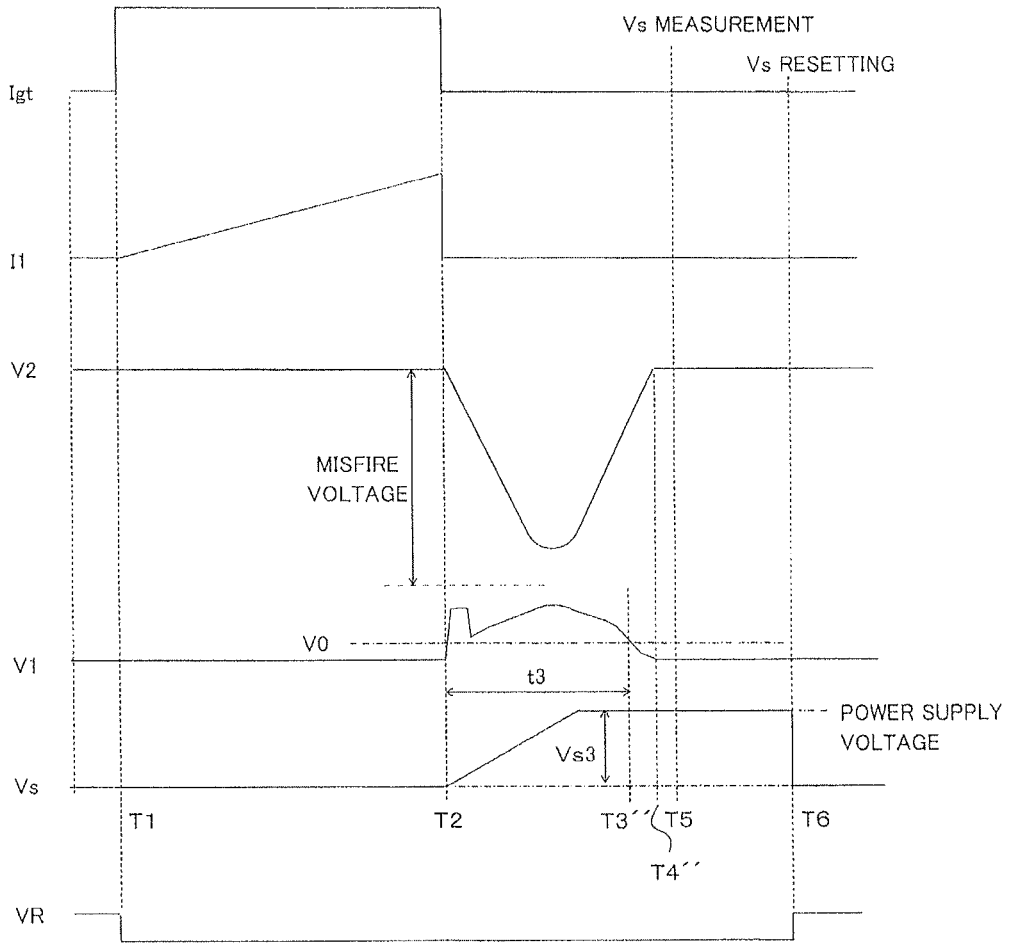
FIG. 4 is a timing chart of the internal combustion engine control apparatus according to the first embodiment of the present invention in the case where the spark plug is in a misfire state.

FIG. 4 is a timing chart of the internal combustion engine control apparatus according to the first embodiment of the present invention in the case where the spark plug 40 is in a misfire state without causing dielectric breakdown. FIG. 4 differs from FIG. 2 referred to above mainly in an operation from a time T3" to a time T4". The operation at the times except for the time period from the time T2" to the time T3" is the same as that illustrated in FIG. 2, and therefore the description thereof is herein omitted.

In the case where dielectric breakdown does not occur in the spark discharge gap in the spark plug 40, the spark discharge is not caused in the spark discharge gap in the spark plug 40. Therefore, a sudden voltage drop occurs neither in the primary coil voltage V1 nor in the secondary coil voltage V2, and the primary coil voltage V1 and the secondary coil voltage V2 both have a gentle waveform as illustrated in FIG. 4. A time period in which the primary coil voltage V1 is above the comparison reference voltage V0 becomes extremely long as represented by a time duration t3. As a result, the capacitor 58 is continuously charged over the long time duration t3. After the capacitor 58 is charged to a charging voltage Vs3 which is the same as the power supply voltage, the charging voltage of the capacitor 58 does not become any higher.

As described above, by measuring the time duration in which the primary coil voltage V1 is above the comparison reference voltage V0 based on the charging voltage Vs of the capacitor 58, the misfire of the spark plug 40 can also be detected.

Figure 5:
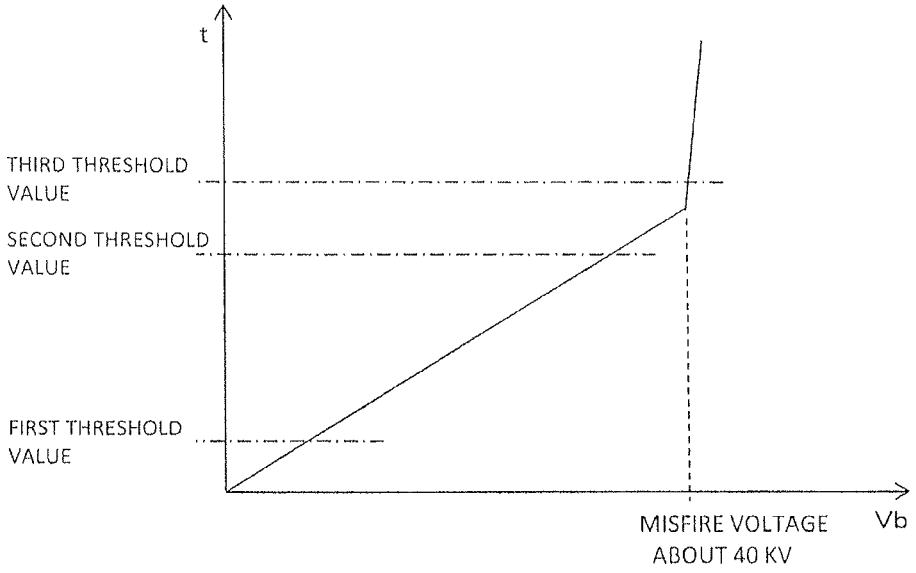
FIG. 5 is a graph showing a relationship between a time duration in which a primary coil voltage V1 is above a comparison reference voltage and the discharge voltage of the spark plug in the internal combustion engine control apparatus according to the first embodiment of the present invention.
Figure 6:
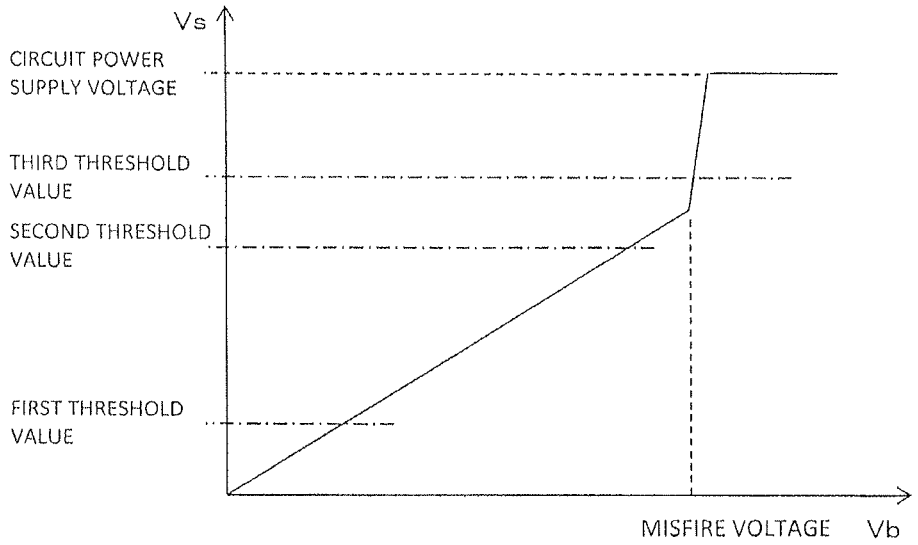
FIG. 6 is a graph showing a relationship between a charging voltage of a capacitor and the discharge voltage of the spark plug in the internal combustion engine control apparatus according to the first embodiment of the present invention.

FIG. 5 is a graph showing a relationship between the time duration in which the primary coil voltage V1 is above the comparison reference voltage V0 and the discharge voltage Vb of the spark plug 40 in the internal combustion engine control apparatus according to the first embodiment of the present invention. FIG. 6 is a graph showing a relationship between the charging voltage Vs of the capacitor 58 and the discharge voltage Vb of the spark plug 40 in the internal combustion engine control apparatus according to the first embodiment of the present invention.

As described above, by measuring the time duration in which the primary coil voltage V1 is above the comparison reference voltage V0 based on the charging voltage Vs of the capacitor 58, the abnormality in the discharge voltage and the misfire of the spark plug 40 can be detected. FIGS. 5 and 6 are exemplary relationship graphs for determining the abnormality in the spark plug 40 based on the time duration or the charging voltage Vs in a specific manner.

In FIG. 5, when a time duration t is equal to or smaller than a first threshold value, it is determined that there is a possibility of a leak discharge occurring at a location other than the spark discharge gap in the spark plug 40. When the time duration t is larger than a second threshold value (>first threshold value) and is equal to or smaller than a third threshold value described below, it is determined that the discharge voltage Vb is abnormally high due to wear of electrodes of the spark plug 40. Further, when the time duration t is larger than the third threshold value (>second threshold value), it is determined that the spark plug 40 is in a misfire state without causing the spark discharge.

In the internal combustion engine control apparatus according to the first embodiment, the charging voltage Vs of the capacitor 58 is approximately proportional to the time duration in which the primary coil voltage V1 is above the comparison reference voltage V0. Therefore, based on the charging voltage Vs instead of the time duration t as shown in FIG. 6, the leak discharge of the spark plug 40, the abnormality in the discharge voltage Vb, and the misfire can be determined by using the same technique.

When the abnormality in the discharge voltage or the misfire is detected, it is possible to prevent uncombusted gasoline from being released out of an internal combustion engine by, for example, warning a driver by displaying the result of detection on a warning indicator of a vehicle or stopping fuel injection controlled by the ECU.

As described above, according to the first embodiment, the abnormality in the discharge voltage and the misfire of the spark plug can be detected by measuring the time duration in which the primary coil voltage is above the predetermined comparison reference voltage based on the charging voltage of the capacitor.

Further, according to the first embodiment, no additional circuit is required for the secondary coil of the ignition coil. Therefore, the internal combustion engine control apparatus can be configured using general low-voltage components without requiring an element which withstands a high voltage. Further, a component and a wiring are not required for a high-voltage side, and a wiring is required only for the primary coil having a low voltage. Thus, the voltage detecting circuit can be realized by general-purpose components for a low voltage. Thus, the costs can be reduced.

Second Embodiment

Figure 7:
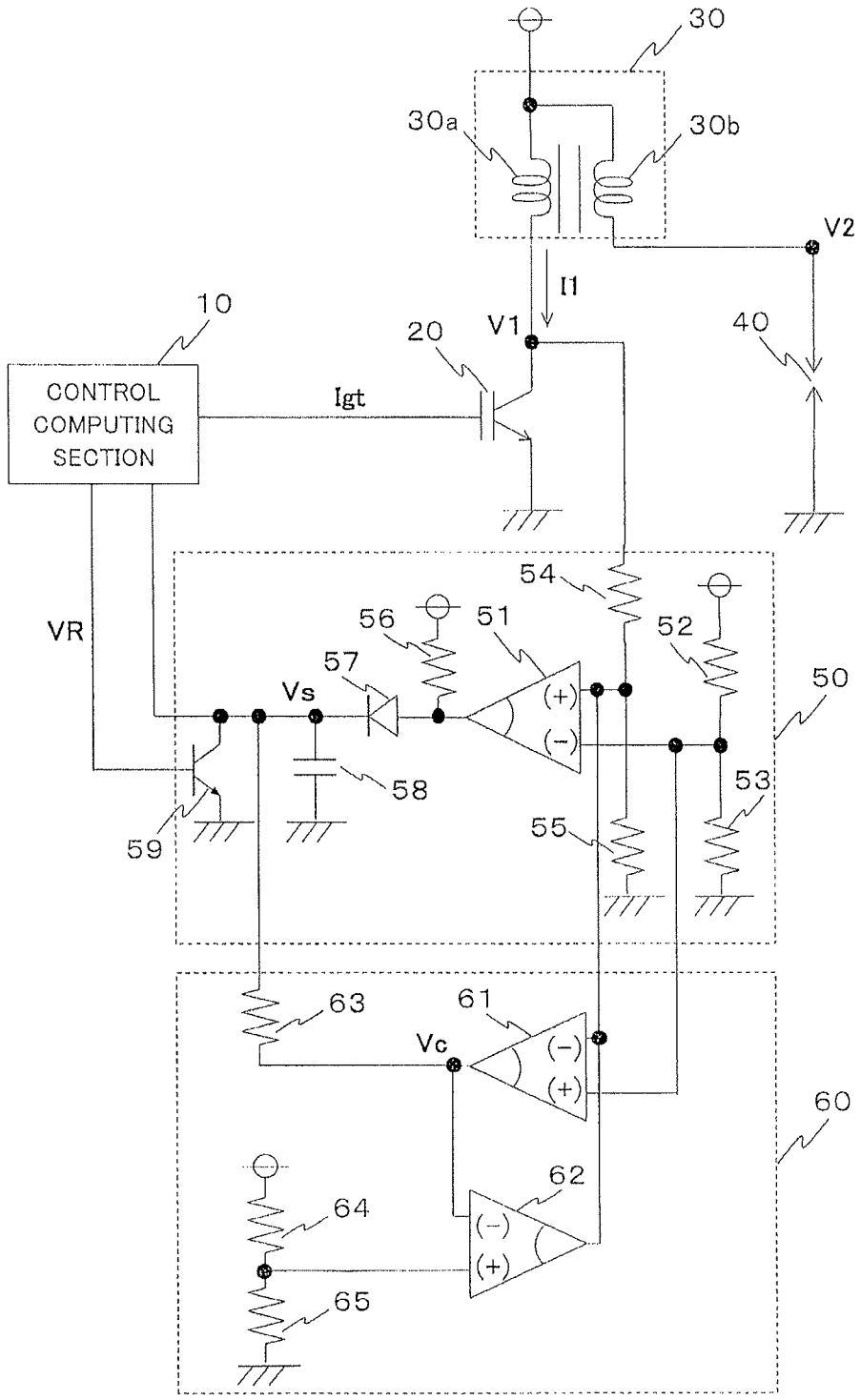
FIG. 7 is an exemplary diagram of a circuit configuration of an internal combustion engine control apparatus according to a second embodiment of the present invention.

FIG. 7 is an exemplary diagram of a circuit configuration of an internal combustion engine control apparatus according to a second embodiment of the present invention. The internal combustion engine control apparatus illustrated in FIG. 7 differs from that illustrated in FIG. 1 according to the first embodiment described above in that a regulator circuit 60 for regulating the operation of the voltage detecting circuit 50 is further provided. The remaining configuration is the same as that illustrated in FIG. 1.

The regulator circuit 60 includes comparators 61 and 62, and resistors 63, 64, and 65. The regulator circuit 60 regulates the voltage detecting circuit 50 of the first embodiment described above so that the voltage detecting circuit 50 responds only to the first spark discharge but not to the subsequent spark discharges even in the case where the spark discharge is caused in the spark plug 40 for a plurality of times. With the regulator circuit 60, the discharge voltage Vb of the spark plug 40 can be more precisely determined.

Figure 8:
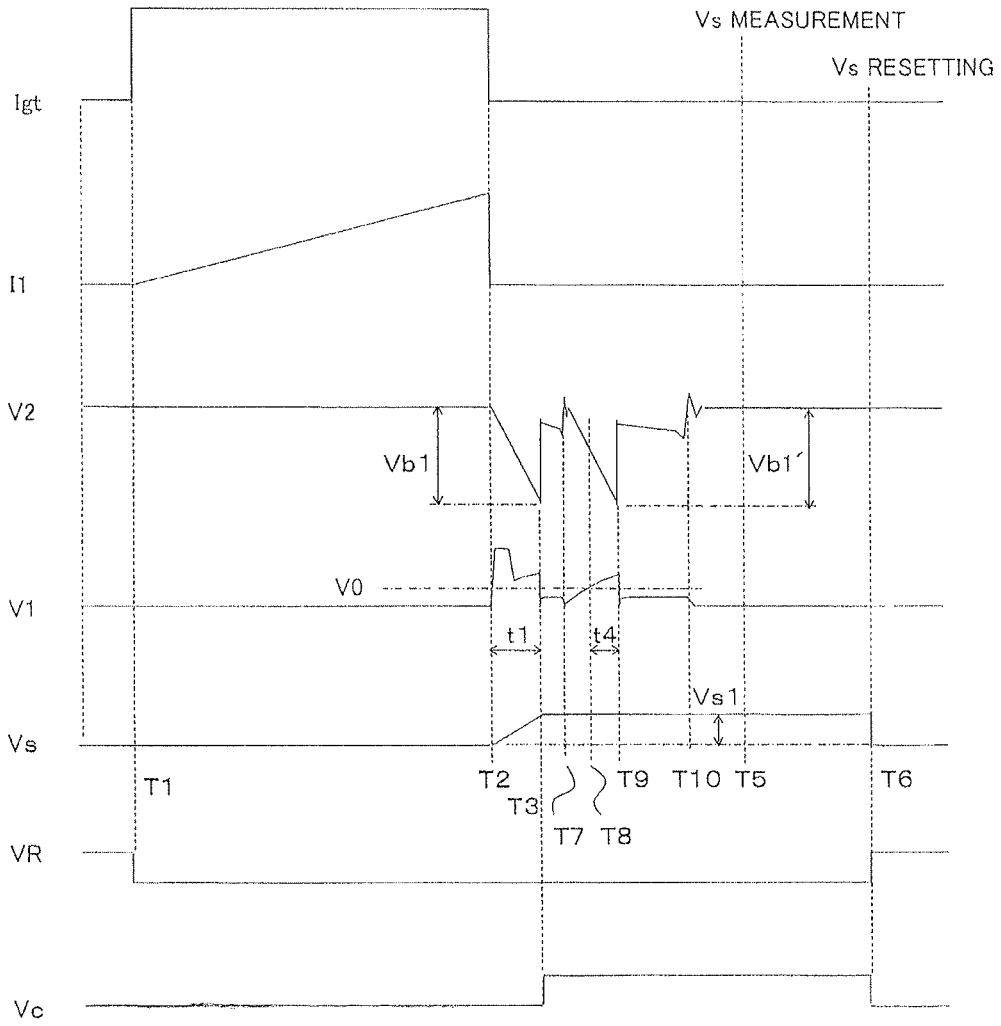
FIG. 8 is a timing chart of the internal combustion engine control apparatus according to the second embodiment of the present invention.

FIG. 8 is a timing chart of the internal combustion engine control apparatus according to the second embodiment of the present invention. FIG. 8 differs from FIG. 2 referred to above mainly in an operation from the time T3 to the time T5. The operation at the times except for the time period from the time T3 to the time T5 is the same as that illustrated in FIG. 2, and therefore the description thereof is herein omitted.

At the time T3, the magnetically induced voltage generated in the secondary coil 30*b* exceeds the discharge voltage Vb1 in the spark discharge gap in the spark plug 40, and then transitions to the glow/arc discharge. Thereafter, at a time T7, the glow/arc discharge is sometimes blown out by an airflow in a combustion chamber.

In this case, an electromotive force of the secondary coil 30*b* increases, for example, due to electromagnetic energy stored in the ignition coil 30. At a time T9, the secondary coil 30*b* exceeds a discharge voltage Vb1' of the spark plug 40 again to transition to the glow/arc discharge. As a result, the primary coil voltage V1 exceeds the comparison reference voltage V0 again. Thus, the time duration measured by the voltage detecting circuit 50 includes not only the time duration t1 which needs to be measured actually but also a time duration t4.

Thus, in the second embodiment, the regulator circuit 60 is further provided. As a result, even in the case where the spark discharge is repeatedly caused as described above, only the first time duration t1 is detected without detecting the second time duration t4. In this manner, the discharge voltage Vb of the spark plug 40 can be more precisely determined.

At the time T3 in FIG. 8, when a (−) input of the comparator 61 of the regulator circuit 60 becomes approximately 0 V and an output from the comparator 61 is in the open collector state, the charging voltage Vs of the capacitor 58 is applied to the (−) input of the capacitor 62 through the resistor 63. The applied charging voltage Vs is a voltage Vc illustrated in FIG. 8. As a result, the output from the comparator 62 is set at the GND level to prevent the primary coil voltage V1 from being applied to a (+) input of the comparator 51. The resistors 64 and 65 are voltage-dividing resistors for generating a small voltage value which is not 0 V, for the comparison with the charging voltage Vs of the capacitor 58.

The control computing section 10 sets the signal VR at the high level to reset the charging voltage Vs of the capacitor 58 to 0 V. In this manner, the voltage Vc illustrated in FIG. 8 is also reset to 0 V to recover the regulator circuit 60 into an initial state.

As described above, according to the second embodiment, even in the case where the spark discharge is repeatedly caused in the spark plug for a plurality of times, only the first discharge voltage is detected to enable more precise detection of the abnormality in the discharge voltage and the misfire of the spark plug.

In the first and second embodiments, the method of measuring the time duration in which the primary coil voltage V1 is above the comparison reference voltage V0 based on the charging voltage Vs of the capacitor 58 has been described. However, the time duration may be directly measured by, for example, using a time measurement function of a microcomputer mounted in the ECU. Even in this case, the second and subsequent time durations (t4) are ignored by the ECU. In this manner, only the first discharge voltage can be measured in the case where the spark discharge is repeatedly caused for a plurality of times.

What is claimed is:

1. An internal combustion engine control apparatus, comprising:

an ignition coil including a primary coil and a secondary coil that are magnetically coupled to each other;

a first switch element for turning on a current to the primary coil when the first switch element is brought into an ON state, and turning off the current to the primary coil when the first switch element is brought into an OFF state;

a control computing section for controlling switching between the ON state and the OFF state of the first switch element; and a spark plug, which is to be driven by a current-interruption type ignition circuit, for igniting an air-fuel mixture in an internal combustion engine by using a spark discharge caused by a magnetically induced voltage generated in the secondary coil by switching of the first switch element from the ON state to the OFF state, wherein the control computing section is configured to:

calculate, as a time duration for determination, a time duration in which a voltage of the primary coil after the switching of the first switch element from the ON state to the OFF state is above a predetermined comparison reference voltage; and determine occurrence of one of an abnormality in a discharge voltage of the spark plug and a misfire of the spark plug when the calculated time duration for determination does not fall within an allowable range.

2. An internal combustion engine control apparatus according to claim 1, wherein the control computing section calculates, as the time duration for determination, a first time duration in which the voltage of the primary coil after the switching of the first switch element from the ON state to the OFF state is above the comparison reference voltage.

3. An internal combustion engine control apparatus according to claim 1, further comprising a voltage detecting circuit comprising:

a comparator for comparing the voltage of the primary coil and the comparison reference voltage in magnitude to output a result of the comparison;

a capacitor for inputting the result of the comparison by the comparator to be charged with power proportional to the time duration in which the voltage of the primary coil is above the comparison reference voltage; and a second switch element for discharging the power charged in the capacitor when the second switch element is brought into an ON state, wherein the control computing section is configured to:

bring the second switch element into the ON state in advance to discharge the power charged in the capacitor before turning on the first switch element; and calculate the time duration for determination based on a charging voltage of the capacitor.

4. An internal combustion engine control apparatus according to claim 3, further comprising a regulator circuit for regulating an input value of the voltage of the primary coil to the comparator based on the charging voltage of the capacitor so that the capacitor is charged in proportion to a first time duration in which the voltage of the primary coil after the control computing section switches the first switch element from the ON state to the OFF state is above the comparison reference voltage.

5. An internal combustion engine control apparatus according to claim 1, further comprising warning means for warning a driver of the abnormality in the discharge voltage of the spark plug and the misfire of the spark plug, wherein, when determining that one of the abnormality in the discharge voltage of the spark plug and the misfire of the spark plug occurs, the control computing section warns the driver by using the warning means.

6. An internal combustion engine control apparatus according to claim 2, further comprising warning means for warning a driver of the abnormality in the discharge voltage of the spark plug and the misfire of the spark plug, wherein, when determining that one of the abnormality in the discharge voltage of the spark plug and the misfire of the spark plug occurs, the control computing section warns the driver by using the warning means.

7. An internal combustion engine control apparatus according to claim 3, further comprising warning means for warning a driver of the abnormality in the discharge voltage of the spark plug and the misfire of the spark plug, wherein, when determining that one of the abnormality in the discharge voltage of the spark plug and the misfire of the spark plug occurs, the control computing section warns the driver by using the warning means.

8. An internal combustion engine control apparatus according to claim 4, further comprising warning means for warning a driver of the abnormality in the discharge voltage of the spark plug and the misfire of the spark plug, wherein, when determining that one of the abnormality in the discharge voltage of the spark plug and the misfire of the spark plug occurs, the control computing section warns the driver by using the warning means.

9. An internal combustion engine control apparatus according to claim 1, further comprising fuel stop means for stopping fuel injection in the internal combustion engine, wherein, when determining that one of the abnormality in the discharge voltage of the spark plug and the misfire of the spark plug occurs, the control computing section stops the fuel injection in the internal combustion engine by using the fuel stop means.

10. An internal combustion engine control apparatus according to claim 2, further comprising fuel stop means for stopping fuel injection in the internal combustion engine, wherein, when determining that one of the abnormality in the discharge voltage of the spark plug and the misfire of the spark plug occurs, the control computing section stops the fuel injection in the internal combustion engine by using the fuel stop means.

11. An internal combustion engine control apparatus according to claim 3, further comprising fuel stop means for stopping fuel injection in the internal combustion engine, wherein, when determining that one of the abnormality in the discharge voltage of the spark plug and the misfire of the spark plug occurs, the control computing section stops the fuel injection in the internal combustion engine by using the fuel stop means.

12. An internal combustion engine control apparatus according to claim 4, further comprising fuel stop means for stopping fuel injection in the internal combustion engine, wherein, when determining that one of the abnormality in the discharge voltage of the spark plug and the misfire of the spark plug occurs, the control computing section stops the fuel injection in the internal combustion engine by using the fuel stop means.

13. An internal combustion engine control apparatus according to claim 5, further comprising fuel stop means for stopping fuel injection in the internal combustion engine, wherein, when determining that one of the abnormality in the discharge voltage of the spark plug and the misfire of the spark plug occurs, the control computing section stops the fuel injection in the internal combustion engine by using the fuel stop means.

14. An internal combustion engine control apparatus according to claim 1, wherein the control computing section is configured to:

determine that a leak discharge occurs in the spark plug when the time duration for determination is equal to or smaller than a predetermined first threshold value;

determine that the abnormality in the discharge voltage of the spark plug occurs when the time duration for determination is larger than a predetermined second threshold value larger than the predetermined first threshold value and is equal to or smaller than a predetermined third threshold value larger than the predetermined second threshold value; and determine that the misfire of the spark plug occurs when the time duration for determination exceeds the predetermined third threshold value.

15. An internal combustion engine control apparatus according to claim 2, wherein the control computing section is configured to:

determine that a leak discharge occurs in the spark plug when the time duration for determination is equal to or smaller than a predetermined first threshold value;

determine that the abnormality in the discharge voltage of the spark plug occurs when the time duration for determination is larger than a predetermined second threshold value larger than the predetermined first threshold value and is equal to or smaller than a predetermined third threshold value larger than the predetermined second threshold value; and determine that the misfire of the spark plug occurs when the time duration for determination exceeds the predetermined third threshold value.

16. An internal combustion engine control apparatus according to claim 3, wherein the control computing section is configured to:

determine that a leak discharge occurs in the spark plug when the time duration for determination is equal to or smaller than a predetermined first threshold value;

determine that the abnormality in the discharge voltage of the spark plug occurs when the time duration for determination is larger than a predetermined second threshold value larger than the predetermined first threshold value and is equal to or smaller than a predetermined third threshold value larger than the predetermined second threshold value; and determine that the misfire of the spark plug occurs when the time duration for determination exceeds the predetermined third threshold value.

17. An internal combustion engine control apparatus according to claim 4, wherein the control computing section is configured to:

determine that a leak discharge occurs in the spark plug when the time duration for determination is equal to or smaller than a predetermined first threshold value;

determine that the abnormality in the discharge voltage of the spark plug occurs when the time duration for determination is larger than a predetermined second threshold value larger than the predetermined first threshold value and is equal to or smaller than a predetermined third threshold value larger than the predetermined second threshold value; and determine that the misfire of the spark plug occurs when the time duration for determination exceeds the predetermined third threshold value.

18. An internal combustion engine control apparatus according to claim 5, wherein the control computing section is configured to:

determine that a leak discharge occurs in the spark plug when the time duration for determination is equal to or smaller than a predetermined first threshold value;

determine that the abnormality in the discharge voltage of the spark plug occurs when the time duration for determination is larger than a predetermined second threshold value larger than the predetermined first threshold value and is equal to or smaller than a predetermined third threshold value larger than the predetermined second threshold value; and determine that the misfire of the spark plug occurs when the time duration for determination exceeds the predetermined third threshold value.

19. An internal combustion engine control apparatus according to claim 9, wherein the control computing section is configured to:

determine that a leak discharge occurs in the spark plug when the time duration for determination is equal to or smaller than a predetermined first threshold value;

determine that the abnormality in the discharge voltage of the spark plug occurs when the time duration for determination is larger than a predetermined second threshold value larger than the predetermined first threshold value and is equal to or smaller than a predetermined third threshold value larger than the predetermined second threshold value; and determine that the misfire of the spark plug occurs when the time duration for determination exceeds the predetermined third threshold value.

* * * * *